US006224112B1

(12) United States Patent
Eriksen et al.

(10) Patent No.: US 6,224,112 B1
(45) Date of Patent: May 1, 2001

(54) CASING SLIP JOINT

(75) Inventors: Erik P. Eriksen, Calgary (CA); David M. Haugen, League City; Salah Mahmoud, Kingwood, both of TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 08/896,755

(22) Filed: Jul. 18, 1997

(51) Int. Cl.[7] ..... F16L 35/00
(52) U.S. Cl. ..... 285/3; 411/5
(58) Field of Search ..... 166/242.7, 85.5; 411/2, 3, 5, 4, 393; 403/2; 285/2, 3

(56) References Cited

U.S. PATENT DOCUMENTS

| | | | | |
|---|---|---|---|---|
| 1,199,029 | * | 9/1916 | Hovis | 285/2 |
| 1,778,477 | | 10/1930 | Wood . | |
| 1,973,702 | | 9/1934 | Cooke . | |
| 2,199,926 | | 5/1940 | Swennes . | |
| 2,283,563 | | 5/1942 | Lyons . | |
| 2,284,199 | | 5/1942 | Greiner . | |
| 2,436,198 | | 2/1948 | Cardwell et al. . | |
| 2,638,167 | | 5/1953 | Jones . | |
| 2,886,289 | | 5/1959 | LeBus . | |
| 2,908,152 | | 10/1959 | Anderson . | |
| 2,918,259 | | 12/1959 | LeBus . | |
| 2,961,219 | | 11/1960 | LeBus, Sr. . | |
| 3,001,387 | | 9/1961 | Schultz . | |
| 3,145,750 | | 8/1964 | Wootton | 411/333 |
| 3,354,950 | | 11/1967 | Hyde | 175/321 X |
| 4,072,190 | | 2/1978 | Raulins | 175/321 X |
| 4,460,046 | | 7/1984 | Pringle | 166/317 |
| 4,688,641 | | 8/1987 | Knieriemen | 166/387 |
| 4,693,316 | | 9/1987 | Ringgenberg et al. | 166/355 |
| 4,874,275 | * | 10/1989 | Gotman | 411/5 |
| 4,890,675 | | 1/1990 | Dew | 166/376 |
| 5,486,079 | * | 1/1996 | Martin et al. | 411/5 X |
| 5,662,443 | | 9/1997 | Dziaba | 411/291 |
| 5,681,135 | * | 10/1997 | Simonson | 411/5 |

FOREIGN PATENT DOCUMENTS

| | | | | |
|---|---|---|---|---|
| 9102441 | | 1/1992 | (DE) . | |
| 1484435 | | 5/1967 | (FR) . | |
| 2199103 | * | 6/1988 | (GB) | 285/2 |

OTHER PUBLICATIONS

Official Gazette of the USPTO, Aug. 12, 1997, p. 1110.
Official Gazette of the USPTO, Nov. 11, 1997, p. 904.

* cited by examiner

*Primary Examiner*—Lynne H. Browne
*Assistant Examiner*—Greg Binda
(74) *Attorney, Agent, or Firm*—Guy McClung

(57) ABSTRACT

A casing slip joint has been invented that has a first tubular casing member disposed around and releasably connected to a second casing member, the second casing member within and surrounded by the first casing member. Self-destructive shear screws according to the present invention releasably hold the first casing member to the second casing member. In one aspect, a shear screw according to this invention has an outer shear screw with a central recess and an inner member therein. In one aspect the outer shear screw is made of one metal and the inner screw is made of another so that contact by a well fluid sets up a galvanic cell that produces stress corrosion cracking in the outer shear screw that weakens it and/or destroys it. The propagation of such cracks is facilitated by placing one or more notches or recesses in the body of the components.

15 Claims, 3 Drawing Sheets

CASING SLIP JOINT

BACKGROUND OF THE INVENTION

1. Field of the Invention

This invention is directed to casing slip joints and to self-destructive fasteners.

2. Description of Related Art

The prior art discloses a variety of casing slip joints that use conventional shear screws or shear fasteners to hold two pieces of a casing slip joint together.

SUMMARY OF THE PRESENT INVENTION

The present invention, in one aspect, discloses a casing slip joint that has a first tubular casing member disposed around and releasably connected to a second casing member, the second casing member within and surrounded by the first casing member. Self-destructive shear screws according to the present invention releasably hold the first casing member to the second casing member. In one aspect, a shear screw according to this invention has an outer shear screw with a central recess. An inner member is introduced into and forcibly held in the central recess of the outer shear screw. The inner member may be an inner screw or bolt that pre-stresses the outer shear screw. In one aspect the outer shear screw is made of one metal and the inner screw is made of another, e.g an outer shear screw made of steel and the inner screw made of aluminum, or vice versa, so that upon contact by a well fluid, e.g. but not limited to an electrolyte, brine, etc., a galvanic cell is formed that produces stress corrosion cracking in the outer shear screw that weakens it and/or destroys it. The propagation of such cracks is facilitated by placing one or more notches or recesses in the body of the components. Such a shear screw will work to hold two pieces of a casing slip joint together while the joint is being run into a wellbore, but, over time, the shear screw will weaken, allowing the casing slip joint pieces to separate.

It is, therefore, an object of at least certain preferred embodiments of the present invention to providen new, useful, unique, efficient, nonobvious casing slip joints and self destructive screws for use therewith.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1:
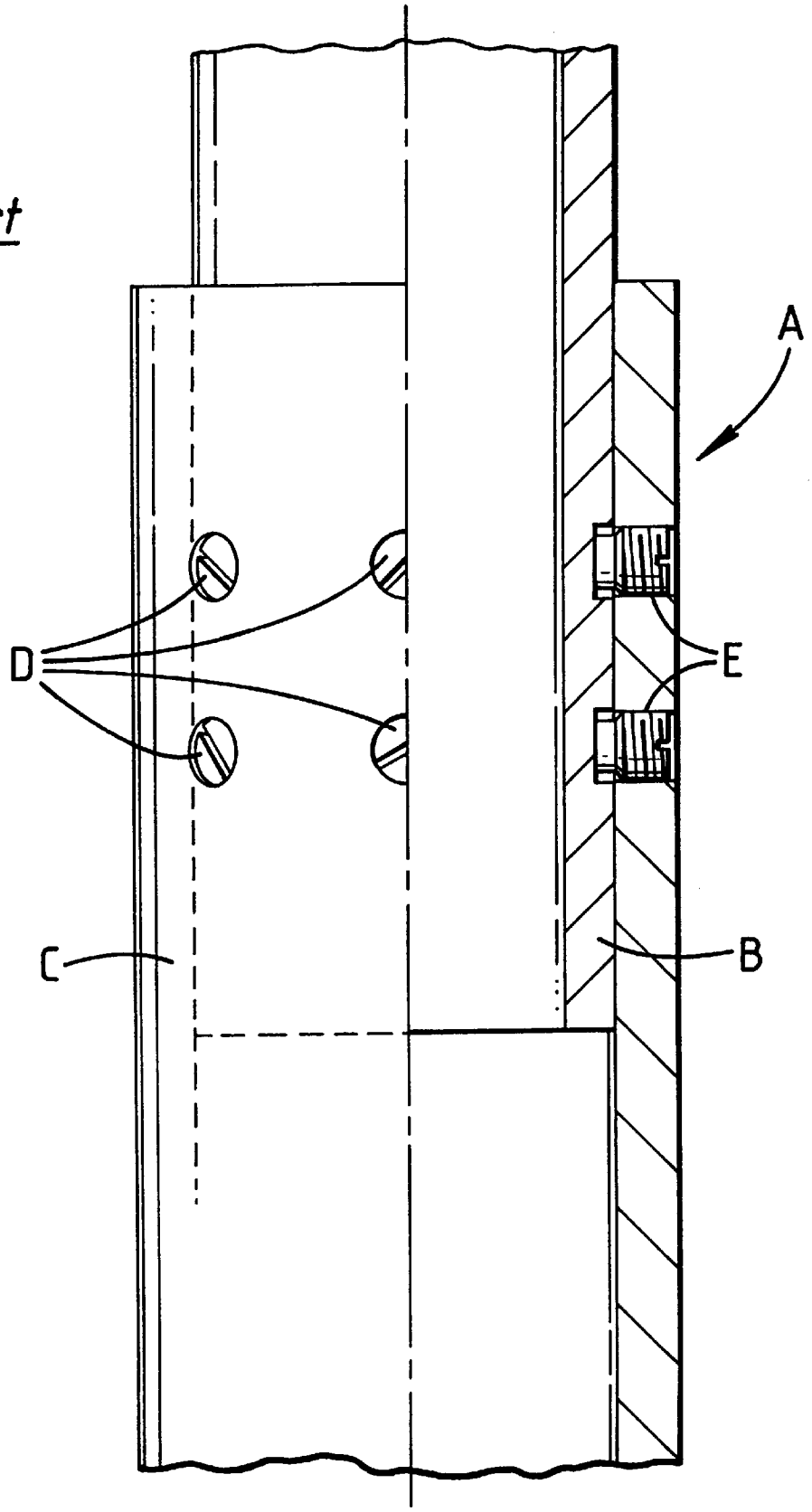
FIG. 1 Prior Art
FIG. 1 is a side view of a prior art casing slip joint with conventional shear screws.

Referring now to FIG. 1, a prior art casing slip joint A has an outer tubular member (e.g. casing) C and an inner tubular member B. Conventional shear screws D in channels E releasably hold the outer tubular member C to the inner tubular member B.

Figure 2:
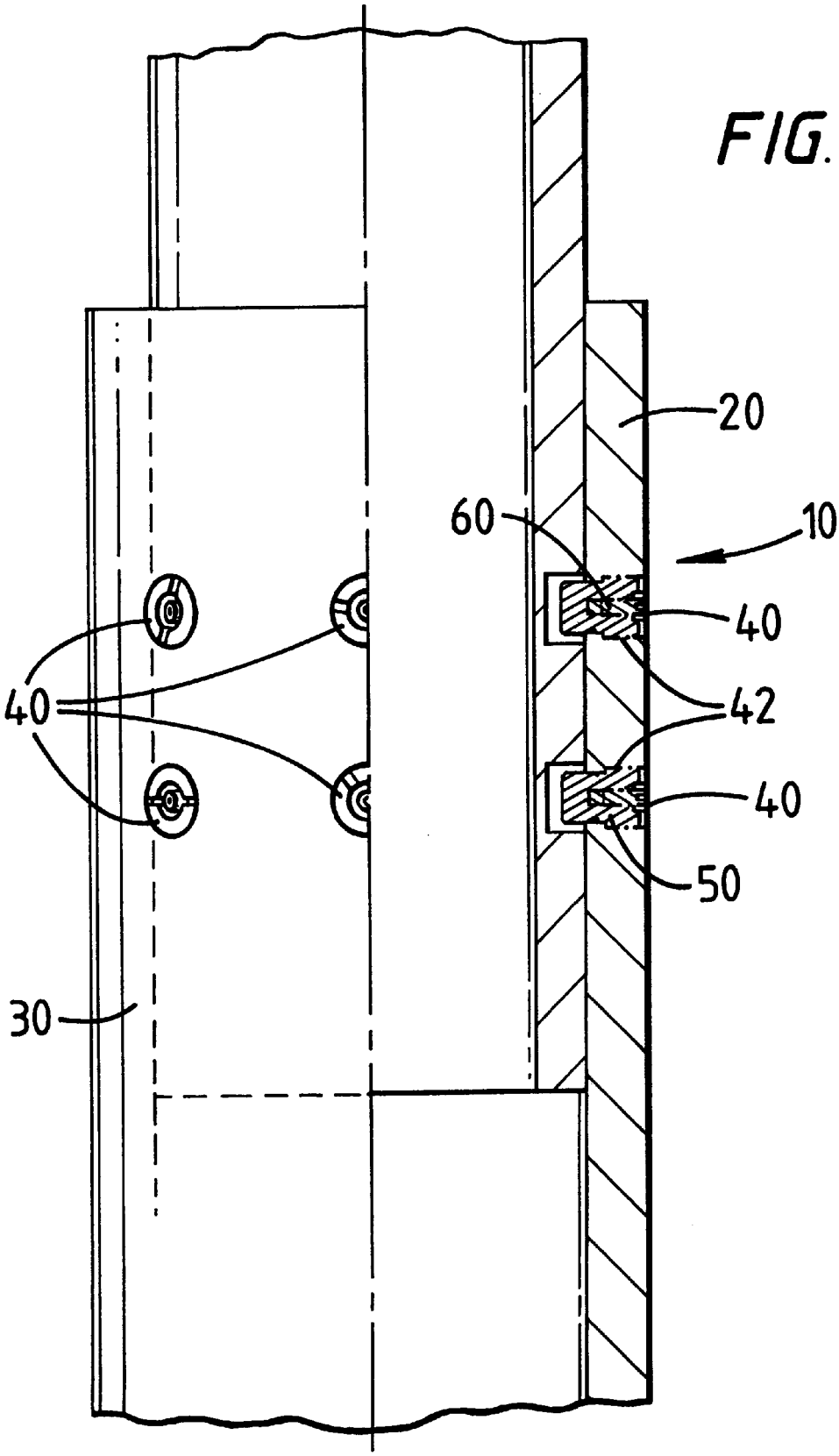
FIG. 2 is a side view of a casing slip joint according to the present invention.

FIG. 2 shows a casing slip joint 10 according to the present invention which has an outer casing 30 (which can be any desired, appropriate length) and an inner casing 20. Self-destructive shear screws 40 in channels 42 through the outer casing 30 releasably attach the two casings together. Each shear screw 40 has an outer shear screw 50 and an inner member 60.

Figure 4A:
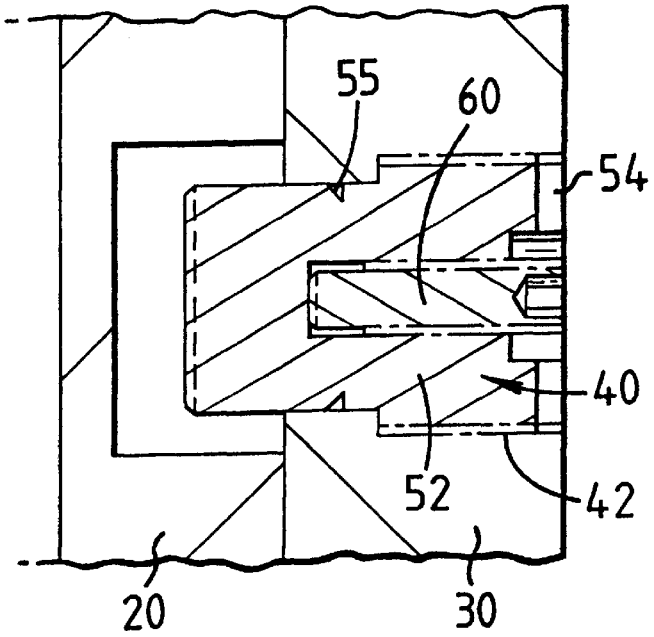
FIG. 4A is a side view of a shear screw according to the present invention.
Figure 4B:
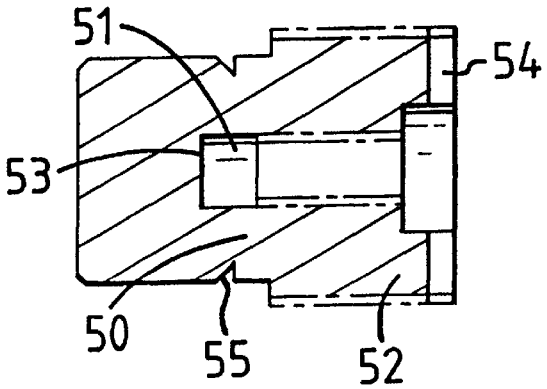
FIG. 4B is a side view in crossection of an outer shear screw member of the shear screw of FIG. 4A.
Figure 4C:
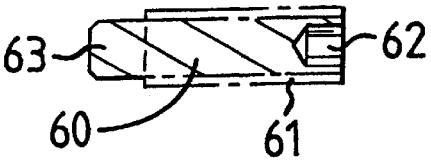
FIG. 4C is a top view of an inner screw member of the shear screw of FIG. 4A.
Figure 4D:
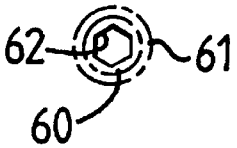
FIG. 4D is a side view of the inner screw member of FIG. 4C.

As shown in FIGS. 4A and 4B, the outer shear screw 50 has a body 52 which is generally cylindrical and an internally threaded inner recess 51 for receiving an inner member 60, the recess having a lower end 53. Preferably the shear screws 50 are sufficiently tightened (e.g. about 7 foot pounds) in place so that they are under tension. As shown in FIGS. 4C and 4D, the inner member 60 has a hexagonal recess 62 into which a correspondingly shaped tool is inserted to threadedly engage threads 61 (indicated by dashed lines) on the inner member 60 with the inner recess 51 of the outer shear screw 50.

In one aspect the outer shear screw and inner member are made of different metals so that, with electrolytic well fluid, they set up an electrolytic cell to induce damage, e.g. but not limited to stress cracking, to the outer shear screw. In another aspect the outer shear screw and the outer casing are made of different metals so that the cell is created. The inner member may be inserted into the outer shear member and fastened (torqued) to such an extent that the lower end 63 pushes against the lower end 53 of the recess 51 of the outer shear member, stressing the outer shear member to facilitate crack propagation. In one case an aluminum outer shear member is anodic to a steel casing. In certain aspects, the inner member is made of steel, iron, brass or aluminum, e.g. but not limited to aluminum alloy 2011-T3. Any electrolytic well fluid may be used including but not limited to brine and salt water. It is within the scope of this invention to adjust the pH of such a well fluid, e.g. by adding acid, e.g. acetic acid. In one aspect pH is adjusted to about 5.5. Prior to running a casing slip joint into a wellbore, the shear screws can be treated with an acid, with salt water, or with an acid-salt water mixture to facilitate initiation of the electrolytic cell effect.

Stress corrosion crackling and/or weakening of the shear screws, in one aspect, is facilitated when the wellbore temperature at the casing slip joint is 150 degrees F. or higher and tensile stress on the outer shear screw by the inner member is about 50% to about 80% of the yield strength of the outer shear screw. A notch 54 across a top portion of the outer shear screw 50 and/or at least one notch 55 around the outer shear screw 50 provide a weakened area from which stress corrosion cracking may propagate.

Figure 3:
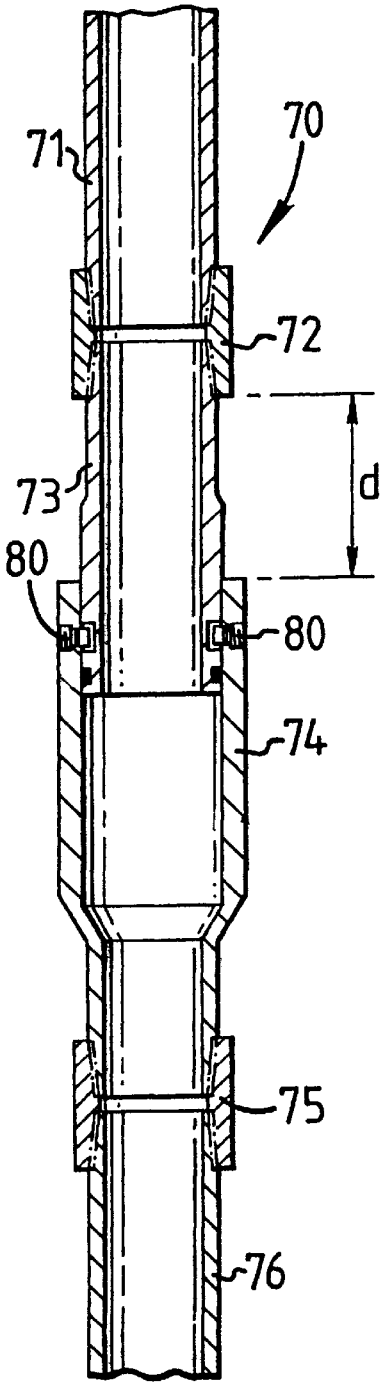
FIG. 3 is a side view in crosssection of a casing slip joint system according to the present invention.

FIG. 3 shows a casing slip joint system 70 with a casing 71 (shown partially), a coupling 72 threadedly connecting the casing 71 and a casing 73, shear screws 80 (e.g. like the shear screws 50) which releasably connect the casing 73 and a casing 74, and a coupling 75 connecting the casing 74 and a casing 76 (shown partially)—all disposed in a wellbore (not shown) as part of a casing string casing the wellbore and cemented therein (cement not shown). Upon weakening and/or destruction of the shear screws 80, the casing 74 may move up to a distance d with respect to the casing 73. The shear screws 50 may be installed with a tool that is placed in the notch 54 for turning or by a tool placed in the hex opening 62 of the inner member 60.

In another aspect the inner member does not occupy the entire recess 51 and an erodeable container containing an electrolyte or an acid is emplaced therein. Alternatively, no inner member is used and such a container is used. In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps.

What is claimed is:

1. A casing slip joint comprising an outer casing and an inner casing releasably secured together by at least one fastener, the at least one fastener a self-destructive apparatus comprising a first outer shear member extending between said inner casing and said outer casing, said first outer shear member provided with an inner recess, wherein said at least one fastener further comprises an inner member in said inner recess, the first outer shear member made of a first metal and the inner member made of a second metal different from the first metal so that upon contact of the first outer shear member and inner member by an electrolyte an electrolytic cell is created that results in damage to the first outer shear member to facilitate shearing of the first outer shear member to release the outer casing from the inner casing.

2. The casing slip joint of claim 1 wherein said inner member and said first outer shear member are correspondingly threaded.

3. The casing slip joint in claim 2 wherein said inner member is provided with a head to facilitate rotation thereof.

4. The casing slip joint of claim 3 wherein said head comprises a socket.

5. The casing slip joint of claim 1 wherein said inner member exerts a force on the first outer shear member in the range of from 50% to 80% of yield strength of said first outer shear member to facilitate weakening of the first outer shear member.

6. The casing slip joint of claim 1 wherein said first outer shear member is provided with at least one notch to facilitate cracking of the first outer shear member.

7. The casing slip joint of claim 1 wherein the first outer shear member is treated with material to facilitate initiation of an electrolytic cell effect.

8. The casing slip joint of claim 7 wherein the material is from the group consisting of acid, salt water, and acid-salt water mixture.

9. The casing slip joint of claim 1 wherein the at least one fastener is a plurality of fasteners spaced-apart around the outer casing and inner casing.

10. A fastener comprising a self-destructive fastener for use between a first member and a second member, said fastener comprising an outer shear screw extending between said first member and said second member and provided with an inner recess, the fastener including an inner member in said recess, the outer shear screw made of a first metal and the inner member made of a second metal different from the first metal so that upon contact of the outer shear screw and inner member by an electrolyte an electrolytic cell is created that results in damage to the outer shear screw to facilitate shearing of the outer shear screw to release the first member from the second member.

11. The fastener of claim 10 wherein said inner member and said outer shear screw are correspondingly threaded.

12. The fastener of claim 10 wherein said inner member exerts a force on said outer shear screw in the range of from 50% to 80% of yield strength of said outer shear screw to facilitate weakening of the outer shear screw.

13. The fastener of claim 10 wherein said outer member has at least one notch to facilitate cracking of the outer shear screw.

14. The fastener of claim 10 wherein the outer shear screw is treated with material to facilitate initiation of an electrolytic cell effect.

15. The fastener of claim 14 wherein the material is from the group consisting of acid, salt water, and acid-salt water mixture.

* * * * *